2/11/86 4,569,796

United States Patent [19]

De Laat et al.

[11] Patent Number: 4,569,796

[45] Date of Patent: Feb. 11, 1986

[54] PROCESS FOR REFINING TRIGLYCERIDE OILS

[75] Inventors: Cornelis I. De Laat, Zevenbergen; Jacobus C. Segers, Nieuwerkerk a/d Ijssel; Albert J. Spits, Oudenbosch, all of Netherlands

[73] Assignee: Lever Brothers Company, New York, N.Y.

[21] Appl. No.: 508,301

[22] Filed: Jun. 27, 1983

[30] Foreign Application Priority Data

Jun. 29, 1982 [GB] United Kingdom ..... 8218749

[51] Int. Cl.[4] ..... C11B 3/06

[52] U.S. Cl. ..... 260/425; 260/413; 260/424

[58] Field of Search ..... 260/425, 413, 424

[56] References Cited

U.S. PATENT DOCUMENTS

| | | | |
|---|---|---|---|
| 2,641,603 | 6/1953 | Clayton . | |
| 2,714,114 | 7/1955 | Scott | 260/425 |
| 3,004,050 | 10/1961 | Ayres | 260/425 |
| 3,454,608 | 7/1969 | Seip | 260/425 |
| 3,629,307 | 12/1971 | Marino et al. | 260/425 |
| 3,700,705 | 10/1972 | Lambone | 260/425 |
| 4,101,563 | 7/1978 | Landis | 260/425 |
| 4,276,227 | 6/1981 | Kirby | 260/425 |

FOREIGN PATENT DOCUMENTS

| | | |
|---|---|---|
| 704591 | 2/1954 | United Kingdom . |
| 766222 | 1/1957 | United Kingdom . |
| 804022 | 11/1958 | United Kingdom . |

*Primary Examiner*—Helen M. S. Sneed

*Attorney, Agent, or Firm*—Milton L. Honig; James J. Farrell

[57] ABSTRACT

Process for refining a triglyceride oil comprising bringing the oil into contact with at least an amount of aqueous alkali solution equal to the stoichiometric amount required to neutralize the oil, forming a soapstock and separating said soapstock and oil characterized by bringing the oil into contact with the aqueous alkali solution at a temperature in the range of from 40° to 140° C. and forming at a temperature in the range of from 40° to 140° C. a soapstock which contains with respect to the initial fatty acid content of the oil at least about 0.7 wt % of electrolyte and which comprises a member selected from the group comprising a single phase of neat soap, a binary phase mixture of neat soap and niger, a binary phase mixture of neat soap and lye and a ternary phase mixture of neat soap, lye and niger. Each of the niger, lye and neat soap phases is a single phase comprising water, electrolyte and soap. The lack of substantial amounts of free water reduces saponification and thus oil loss. The presence of niger and/lye can reduce the viscosity of the soapstock and hence aid its separation from the oil.

17 Claims, 1 Drawing Figure

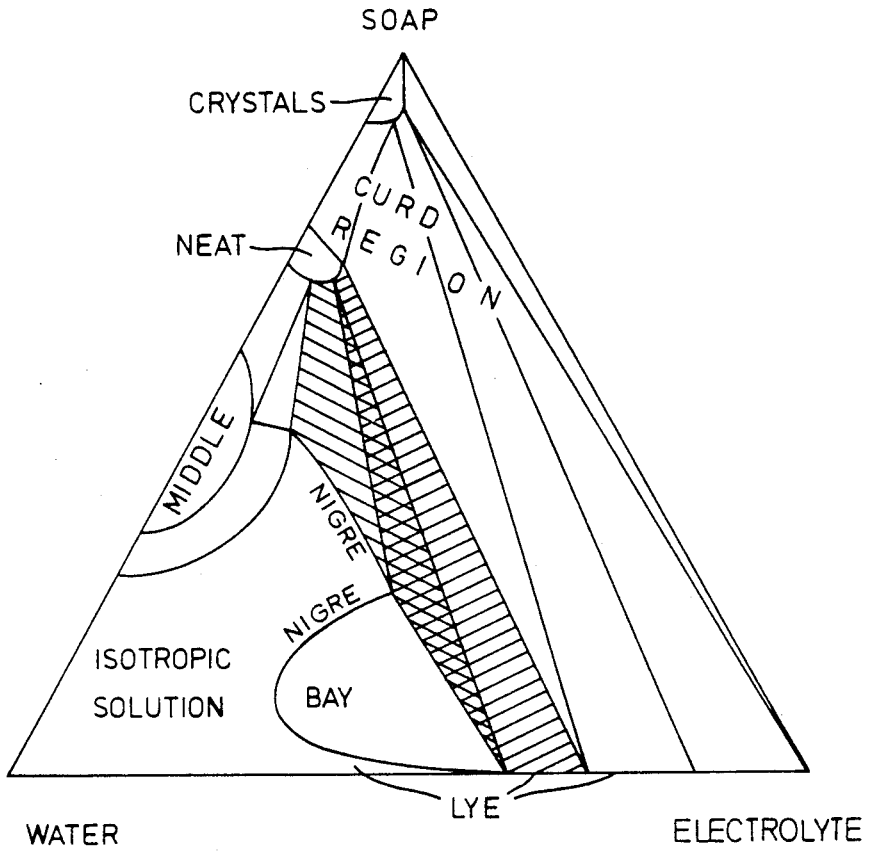
SOAP
CRYSTALS
CURD REGION
NEAT
MIDDLE
NIGRE
NIGRE
ISOTROPIC SOLUTION
BAY
LYE
WATER
ELECTROLYTE

PROCESS FOR REFINING TRIGLYCERIDE OILS

The present invention relates to a process for refining triglyceride oils, particularly edible triglyceride oils, and to the oils so refined.

Crude triglyceride oils contain a variety of impurities whose presence effects not only the taste of the oils, but also in many instances their keepability. The impurities include free fatty acids (ffa), waxes and gums and the like such as phosphatides.

One step in the conventional refining of oils comprises the addition of an aqueous alkali solution followed by separation of the oil from the resulting aqueous and soap stock phases. Problems encountered in the process include inadequate removal of the impurities, saponification of the oil, entrainment of oil with the soapstock/water phases as well as difficulties in breaking the emulsion which may form between the oil and the aqueous phase.

Many proposals have been put forward in attempts to optimise the process. Examples of different approaches employed with respect to the problems encountered are found in U.S. Pat. No. 2,641,603, GB-A-766 222 and GB-A-804 022 respectively.

U.S. Pat. No. 2,641,603 describes a process in which a thick and viscous soapstock is prepared at a temperature between 70° and 110° F. and is subsequently treated at a higher temperature with a soda ash solution. The thick and viscous soapstock entrains a substantial amount of neutral oil. The soda ash solution treatment is thus required to not only render the soapstock solution separable from the bulk of the oil, but also to release entrained oil from the soapstock. Although no examples are given by which to judge the efficacy of the process oil losses can be expected to occur due to the admixture of the oil with the thick soapstock.

GB-A-766 222 teaches contacting the neutralising agent and oil for a very short period only, preferably for a contact time of 0.1 second or less, so as to minimise losses due to saponification. An excess of alkali is used to obtain complete neutralistion in the process described. Notwithstanding the precautions taken however the Examples in the specification record a refining loss ranging from 1.1% to 7.8%.

GB-A-804 022 describes a refining process in which attention is paid to the type of soap formed. The soap should be single phase and coarse grained such that it can be easily retained in the sludge space of a centrifuge from which the firmly compressed soap can be periodically removed. The specification teaches however use of relatively long reaction times to allow any excess alkali present to saponify the oil. Water in the excess alkali solution is thus prevented from forming a third phase.

According to the present invention there is provided a process for refining a triglyceride oil comprising bringing the oil into contact with at least an amount of aqueous alkali solution equal to the stoichiometric amount required to neutralise the oil, forming a soapstock and separating said soapstock and oil characterised by bringing the oil into contact with the aqueous alkali solution at a temperature in the range of from 40° to 140° C. and forming at a temperature in the range of from 40° to 140° C. a soapstock which comprises a member selected from the group comprising a single phase of neat soap, a binary phase mixture of neat soap and niger, a binary phase mixture of neat soap and lye and a ternary phase mixture of neat soap, lye and niger and which contains with respect to the initial fatty acid content of the oil at least about 0.7 wt% of electrolyte.

Neat soap, niger and lye are each terms employed in soap-making. Each term refers to a different homogeneous soapstock phase containing water, soap and an electrolyte. A schematic three component phase diagram for such a system at 100° C. is given in McBain et al J.A.O.C.S. 60 1666 (1938) and reproduced at page 66 of "Soap Manufacturing" by Davidson et al (1953). The accompanying drawing is taken in a somewhat adapted form from the McBain article. Referring to the drawing the single phase neat soap region is labelled "neat", the binary phase mixture of neat soap and niger is the cross-hatched area extending between the single phase neat area and the niger region of the isotropic solution area, the binary phase mixture of neat soap and lye is the cross-hatched area extending between the single phase neat area and the base line at 0% soap concentration, and the tertiary phase mixture of neat soap, niger and lye is the double-cross-hatched area lying between the two areas indicating respectively the two binary phase mixtures. The actual position of the boundaries between various regions in the phase diagram in any particular case will depend inter alia on for example the materials used and the ambient temperature. For example McBain et al "Oil and Soap" 20 17 (1943) gives a number of binary phase diagrams for various water-soap systems as a function of temperature. The diagrams are reproduced at pages 67, 74 and 75 of the Davidson et al book mentioned above. Not only do the positions of the various phase boundaries vary with temperature, but marked differences can be seen among the different systems.

Due to the composition of the soapstock in the present process no substantial amounts of free water need be present in the system. The present process thus provides a means of refining triglyceride oils in which the previously encountered problems can be overcome or at least substantially reduced. In addition the lack of free water in the system reduces the emulsification of the oil phase in an aqueous phase. Saponification between the triglycerides and the alkali can thus be inhibited resulting in overall reduced oil losses. Use of the present invention can for example allow fatty acid factors as low as 3 or 2 or even 1 and refining factors of the order of 2 to 1.5 to be achieved. In each case moreover the soapstock can be readily separated from the oil phase.

The presence of niger and/or lye has been found to be advantageous in that a soapstock mixture including niger and/or lye can have reduced viscosity compared to that of neat soap alone. Separation of the soapstock and oil phases can thus be achieved more readily. A preferred method of separation comprises centrifuging. A soapstock mixture of relatively low viscosity can in particular aid discharge of a free-flowing soapstock phase from the centrifuge and thus permit continuous centrifuge operation without the need to remove periodically soapstock collected in a compressed form in the centrifuge bowls. A further advantage attributable to the presence of niger is that at least some of the coloured bodies naturally present in the oil can solubilise in it and thus be removed. Any subsequent bleaching step which may be applied to the oil may thus require less bleaching earth.

The electrolyte can for example be an alkali, which may be the same as that employed in the aqueous alkaline solution, or be a salt. The electrolyte may be added before, at the same time or after the aqueous alkaline solution is brought into contact with the oil. The only requirement is that at least 0.7% by weight electrolyte is present in the soapstock to be separated from the oil compared to the initial amount of free fatty acid in the oil. Where some or all of the electrolyte is provided by salt it is preferably in the form of an aqueous solution and suitably comprises sodium, potassium or ammonium chloride, carbonate, sulphate, phosphate, citrate or mixtures thereof. An alternative method of ensuring the required presence of the electrolyte comprises adding excess alkali. A further option comprises addition of excess alkali which may then neutralise any inorganic or other non fatty acids present in the oil and so produce the necessary electrolyte. The oil may for example have been pre-treated with for instance phosphoric or citric acid, which on neutralisation with for example sodium hydroxide yields the necessary electrolyte. Preferably the amount of electrolyte present in the soapstock is less than 30 wt%, more preferably less than 25 wt%, even more preferably less than 20 wt%, with respect to the original free fatty acid content of the oil. Preferably the amount of electrolyte is more than 1 and less than 8 wt% with respect to the free fatty acid content of the oil.

The actual amount and concentration of aqueous alkaline solution required to be brought into contact with the oil will in each case depend on a variety of factors. The concentration of the aqueous alkali solution may be as low as 2N or even 1N. In general terms however the aqueous alkaline solution is preferably at least 4N, more preferably at least 6N, even more preferably at least 8N in strength. Suitably the solution can be up to 14N or even 18N. Suitably where the alkali is employed as the electrolyte the aqueous alkaline solution is employed in an amount at least 5 to 250%, preferably 5 to 100%, in stoichiometric terms in excess of that required to neutralise the oil. Suitably the alkaline solution is employed at least 30% in stoichiometric excess and up to 50% in stoichiometric excess. It has moreover been found that to form a soapstock of the desired characteristics the weaker the alkali solution the greater the amount of excess electrolyte is required and vice versa. It is however to be stressed that the particular alkali and electrolyte requirements for any particular oil should merely be chosen having regard to the need to form the desired form of soapstock. Preferably, however, use of an alkali solution of a concentration greater than about 2N, more preferably greater than about 4N, is employed in order to reduce effluent problems in disposal. The acids present in the oil may comprise not only free fatty acids, but also any acids added to the oil as part of an earlier treatment. The alkalis employed are preferably caustic alkalis, such as the alkali hydroxides, the preferred alkali being sodium hydroxide. The aqueous alkali solution as well as the electrolyte solution can be admixed with the oil by any suitable means such as a mechanical mixer or a static mixer.

The aqueous alkali solution is preferably brought into contact with the oil at a temperature below 100° C. and a temperature above 45° C., more preferably above 50° C. A preferred temperature range comprises from 70° to 80° C.

The soapstock is formed at a temperature within the range of from 40° to 140° C. The actual temperature selected for any particular case will depend on among other things the equilibria between the various phases in the system. Preferably, the soapstock is formed at a temperature above 60° C., more preferably at a temperature about 80° C. A preferred upper temperature is 120° C., a more preferred upper temperature being 100° C. For a variety of systems particularly suitable temperatures lie within the range of from 80° to 100° C. If desired the aqueous alkali solution can be brought into contact with the oil at the same temperature at which the soapstock is formed. The separation step may in addition be performed at the same temperature.

The time required for neutralisation of the oil to occur will depend among other things on the temperature and the presence of for example traces of lecithin in the oil. The time between bringing the oil into contact with the aqueous alkali solution and separating the soapstock may be as short as 0.1 sec or as long as 30 minutes. A preferred time is between 0.1 and 5.0 sec, a more preferred time between 0.1 sec and 5 minutes. The very short times can be adchieved where the process is carried out in a continuous fashion.

The oil can be separated from the soapstock by any suitable means. Centrifuging either continuously or batchwise may for example be conveniently employed. Other suitable means include filtration, in particular mechanical or electro-filtration, and gravitational settling. The process as a whole may be carried out in a continuous, semi-continuous or batchwise fashion.

The process can be applied to any marine, animal or vegetable triglyceride oil. Examples of edible triglyceride oil for which the present process can be particularly useful include fish oil, tallow, palm oil, sunflower oil, rapeseed oil, soyabean oil and groundnut oil, mixtures and fractions thereof. Due to the particular neutralisation problems encountered with fish oil, tallow and palm oil their use in the present invention can be particularly advantageous. Conventional processing steps such as bleaching, deodorisation, hydrogenation and interesterification can be applied to the product of the present process.

It is to be understood that the present invention extends to triglyeride oils that have been treated by the present process and to the materials removed from the oils so treated.

Embodiments of the present invention will now be described by way of example only. The refining factor mentioned in each of Examples 1 to 4 is the ratio of total oil loss to free fatty acid in the crude oil. The fatty acid factor mentioned in each of Examples 5 to 8 is the ratio in weight terms of the sum of the total fatty matter in the soapstock and residual soap in the refined oil to the difference between free fatty acid in the starting oil and the residual free fatty acid in the refined oil.

EXAMPLE 1

Crude fish oil having a free fatty acid content of 3.5wt% and a moisture content of 0.4wt% was firstly admixed at 90° C. with 500 ml concentrated (75 wt%) aqueous solution of phosphoric acid ($H_3PO_4$) per $m^3$ of oil. The resulting solution was then admixed with 9.5N sodium hydroxide solution in an amount such that the alkali was present in a stoichiometric excess of 35%, the excess being calculated with respect to the amount of alkali required to neutralise the free fatty acid and the added phosphoric acid.

After separation by centrifugation of the soapstock formed which comprised a binary mixture of neat soap and lye and two subsequent washing steps the free fatty acid content of the neutralised oil was 0.05 wt% and the refining factor was 1.45.

In another experiment a crude fish oil with a free fatty acid content of 2.8wt% and a moisture content of 1.2wt% was refined employing the same procedure with the exception that 1 l conc. $H_3PO_4$ per $m^3$ oil and about 8% stoichiometric excess of 9N sodium hydroxide solution were employed. A relatively viscous neat soap phase formed. After separation by centrifugation and two subsequent washing steps the free fatty acid content of the oil was measured to be 0.10wt% and the refining factor was 1.78. The higher refining factor indicates that slightly larger amounts of oil were lost and reflects the more viscous nature of the soapstock formed.

EXAMPLE 2

Crude edible tallow with a free fatty acid content of 2.20 wt% was refined using 0.6 l conc. (75 wt%) $H_3PO_4$ per $m^3$ oil by a procedure similar to that employed in Example 1. In the present case however three runs were performed employing different strengths and excesses of sodium hydroxide solution. The results are given in Table I below.

TABLE I

| Run | Stoichiometric NaOH excess (%) | NaOH Strength (N) | Refining factor |
|---|---|---|---|
| A | 10 | 4 | 2.2 |
| B | 10 | 9 | 1.9 |
| C | 36 | 9 | 1.4 |

Neat soap formed in both runs B and C which each had a lower refining factor, indicating lower oil losses, than run A. The improved refining factor in run C was due to the presence of niger which formed in the presence of a high excess of NaOH and resulted in a soapstock phase of reduced viscosity. The lower viscosity aided the separation of the oil and soapstock and thus resulted in lower oil loss.

EXAMPLE 3

Crude fish oil having a free fatty acid content of 5wt% was neutralised at 80° C. with a 9N aqueous solution of sodium hydroxide. To effect neutralisation a stoichiometric amount of the sodium hydroxide solution was added, calculated with respect to the free fatty acid content, plus a 0.2% excess. The mixture was stirred for 1 minute after which 11.4 l of a 20 wt% NaCl aqueous solution was added per $m^3$ of oil. The resulting emulsion was broken and heated to 95° C. at which temperature the soapstock comprising a binary mixture of neat soap and lye was separated from the oil.

The resulting refining factor was 1.4. The free fatty acid content of the oil after neutralisation was 0.2 wt%.

EXAMPLE 4

Crude soyabean oil which had been degummed to a free fatty acid content of 0.5 wt% and a phosphorus content of 30 ppm was neutralised at 90° C. with 7N aqueous solution of sodium hydroxide at 50% stoichiometric excess calculated with respect to the free fatty acid content. The resulting soapstock comprised a mixture lying within the cross-hatched area of the drawing was immediately separated from the remainder of the oil using a centrifuge. The oil was then washed soap free with 10% wash water. The refining factor was 1.4. The free fatty acid content of the neutralised oil was 0.07 wt%.

EXAMPLE 5

Eight branches of a fish oil/fatty acid mixture were prepared. In each case 1500 g neutralised dried fish oil was mixed with 46 g stearic acid, the stearic acid being 98% pure with the balance comprising palmitic acid and arachidic acid. Each batch was heated to 90° C. and then mixed with different amounts of aqueous NaOH of varying concentrations. In each case the amount and concentration of NaOH solution was selected so that the soapstock formed had a predetermined structure. The amounts of NaOH and water employed and the respective soapstock (eg. neatsoap; neatsoap and niger; neatsoap and lye; neatsoap, niger and lye) formed are given in Table II below.

The various mixtures of oil/fatty acid and aqueous sodium hydroxide solution were stirred for 3 minutes and separated at 90° C. by a heated batch-type centrifuge. The results of the neutralisations in term of fatty acid factor are given in Table II. The oil losses were calculated from the volume of the soapstock fraction and the composition of the oil phase fraction.

In the present example the stoichiometric amount of sodium hydroxide required to neutralise the fatty acid in the oil was 6.48 g NaOH.

TABLE II

| Batch No. | NaOH(g) added | $H_2O$(g) added | Soapstock formed | Fatty acid factor |
|---|---|---|---|---|
| 1 | 6.48 | 34.2 | neat | 3.9 |
| 2 | 7.4 | 47.1 | neat | 1.6 |
| 3 | 7.7 | 93.2 | neat/middle | 2.6 |
| 4 | 7.1 | 94.4 | middle | 4.5 |
| 5 | 8.4 | 270.9 | niger | >10 |
| 6 | 8.6 | 94.4 | neat/niger | 1.2 |
| 7 | 16.0 | 211.9 | neat/niger/lye | 1.6 |
| 8 | 10.7 | 118.3 | neat/lye | 1.5 |

The lowest acceptable scores in terms of oil losses were given by batches 2,6,7 and 8. Only these batches employed at least a 0.7 wt% excess of sodium hydroxide with respect to the free fatty acid content of the oil and formed a soapstock fraction comprising a neat phase; neat and niger phases; neat and lye phases; or neat, lye and niger phases.

EXAMPLE 6

Ten batches each comprising 1500 g neutralised dried fish oil and 46 g palmitic acid were made up. The palmitic acid was of 93% purity, the balance comprising myristic acid and stearic acid. Each batch was heated to 90° C. and then mixed with a predetermined amount of NaOH in a predetermined strength as an aqueous solution. The amount and concentration of NaOH were selected to give soapstock fractions having a variety of predetermined structures. Each mixture of oil, fatty acid and NaOH solution was stirred for 3 minutes and separated at 90° C. by a heated batch-type centrifuge. Table III below gives the amount and strength of NaOH solution employed in each case and the structure of the resulting soapstock fraction. The Table also gives the fatty acid factor in each case which was calculated from the volume of the soapstock fraction and the composition of the oil phase and is an indication of oil loss. In the present instance the stoichiometric amount of NaOH required to neutralise the palmitic acid was 7.19 g.

TABLE III

| Batch No. | NaOH(g) added | $H_2O$(g) added | Soapstock formed | Fatty acid factor |
|---|---|---|---|---|
| 1 | 7.3 | 20.7 | neat | 2.8 |
| 2 | 7.4 | 20.9 | neat | 11.6 |
| 3 | 7.5 | 21.2 | neat | 6.9 |
| 4 | 7.7 | 21.7 | neat | 2.1 |
| 5 | 7.4 | 39.1 | neat/middle | 3.9 |
| 6 | 7.6 | 64.4 | middle | 2.2 |
| 7 | 8.0 | 257.0 | niger | >10 |
| 8 | 8.7 | 36.9 | neat/niger | 1.5 |
| 9 | 9.5 | 40.1 | neat/niger/lye | 2.0 |
| 10 | 10.0 | 42.3 | neat/lye | 1.9 |

Batch nos. 4, 8, 9 and 10 gave the lowest acceptable free fatty acid factors.

EXAMPLE 7

Eight batches each comprising 1500 g neutralised dried tallow oil mixed with 46 g stearic acid having a purity of 98% the balance being palmitic acid and arachidic acid were made up. Each batch was heated to 90° C. and mixed with a predetermined amount of NaOH in an aqueous solution of predetermined strength, different amounts and strengths being selected for each batch so that each batch had a soapstock fraction of a predetermined structure. Each mixture was stirred for 3 minutes and then separated at 90° C. using a heated batch-type centrifuge.

The various amounts and concentrations of NaOH as well as the structure of the resulting soaptock are given in Table IV. The oil loss in each case was calculated from the volume of the soapstock and the composition of the oil phase and is indicated by the "fatty acid factor" in the Table. In the present Example the stiochiometric amount of NaOH required to neutralise the free fatty acid was 6.48 g.

TABLE IV

| Batch No. | NaOH(g) added | $H_2O$(g) added | Soapstock formed | Fatty acid factor |
|---|---|---|---|---|
| 1 | 6.48 | 32.3 | neat | 8.1 |
| 2 | 6.79 | 43.2 | neat | 5.8 |
| 3 | 7.4 | 47.1 | neat | 2.8 |
| 4 | 7.7 | 93.2 | neat/middle | 3.1 |
| 5 | 7.1 | 94.4 | middle | >10 |
| 6 | 8.4 | 270.9 | niger | >10 |
| 7 | 8.6 | 94.4 | neat/niger | 2.8 |
| 8 | 16.0 | 211.9 | neat/niger/lye | 2.5 |

Batch nos. 3, 7 and 8 gave the lowest and acceptable free fatty acid factors.

EXAMPLE 8

Eight batches each comprising 1500 g neutralised dried soyabean oil and 46 g stearic acid were prepared. The stearic acid was of 98% purity, the balance being palmitic acid and arachidic acid. Each batch was heated to 90° C. and mixed with a predetermined amount of aqueous NaOH solution of predetermined strength, different amounts and strengths being employed for each batch. Each mixture was stirred for 3 minutes and separated in a heated batch-type centrifuge at 90° C.

The amount and strength of NaOH aqueous solution employed in each case and resulting structure of the soapstock are given in Table V. The oil loss in each case was calculated from the volume of the soapstock fraction and the composition of the oil phase and is indicated in the table by the fatty acid factor. The stoichiometric amount of NaOH required to neutralise the fatty acid was 6.48 g.

TABLE V

| Batch No. | NaOH(g) added | $H_2O$(g) added | Soapstock formed | Fatty acid factor |
|---|---|---|---|---|
| 1 | 6.58 | 32.7 | neat | 7.2 |
| 2 | 7.4 | 47.1 | neat | 4.1 |
| 3 | 7.7 | 85.1 | neat/middle | 6.0 |
| 4 | 7.1 | 94.4 | middle | 8.4 |
| 5 | 8.4 | 270.9 | niger | >10 |
| 6 | 8.6 | 94.4 | neat/niger | 2.2 |
| 7 | 16.0 | 211.9 | neat/niger/lye | 1.1 |
| 8 | 10.7 | 118.3 | neat/lye | 2.0 |

Batches nos. 2, 6, 7 and 8 gave the lowest fatty acid factors.

We claim:

1. Process for refining a triglyceride oil comprising bringing the oil into contact with at least an amount of aqueous alkali solution equal to the stoichiometric amount required to neutralise the oil, forming a soapstock and separating said soapstock as a single entity from the oil characterised by bringing the oil into contact with the aqueous alkali solution at a temperature in the range from 40° to 140° C. and forming at a temperature in the range from 40° to 140° C. a soapstock which comprises a member selected from the group consisting of a single phase of neat soap, a binary phase mixture of neat soap and niger, a binary phase mixture of neat soap and lye and a ternary phase mixture of neat soap, lye and niger and which contains with respect to the initial fatty acid content of the oil at least about 0.7 wt% of electrolyte, aqueous alkali solution being employed in a stoichiometric excess of up to 250% of the amount required to neutralise the oil.

2. Process according to claim 1 wherein the electrolyte is present in the soapstock in an amount of less than 30 wt% with respect to the initial free fatty acid content of the oil.

3. Process according to claim 2 wherein the electrolyte is present in the soapstock in an amount between 1 and 20 wt% with respect to the initial free fatty acid content of the oil.

4. Process according to claim 1 wherein the electrolyte is added to the oil in the form of an aqueous solution.

5. Process according to claim 1 wherein the electrolyte is present in the oil prior to or on bringing the oil into contact with the aqueous alkali solution.

6. Process according to claim 1 wherein the electrolyte is brought into contact with the oil at the same time as the aqueous alkali solution.

7. Process according to claim 1 wherein the electrolyte is the same as the alkali employed in the aqueous alkali solution.

8. Process according to claim 7 wherein the alkali is employed in a stoichiometric excess of between 5 and 250% of the amount required to neutralise the oil.

9. Process according to claim 8 wherein the alkali is employed in a stoichiometric excess of between 5 and 100% of the amount required to neutralise the oil.

10. Process according to claim 9 wherein the alkali is employed in a stoichiometric excess of between 30 and 50% of the amount required to neutralise the oil.

11. Process according to claim 1 wherein the aqueous alkali solution has a concentration of at least 1N.

12. Process according to claim 11 wherein the aqueous alkali solution has a concentration of at least 4N.

13. Process according to claim 12 wherein the aqueous alkali solution has a concentration between 8N and 18N.

14. Process according to claim 1 wherein the oil is brought into contact with the aqueous alkali solution at a temperature between 45° and 100° C.

15. Process according to claim 1 wherein the soapstock is formed at a temperature between 60° and 120° C.

16. Process according to claim 15 wherein the soapstock is formed at a temperature between 60° and 100° C.

17. Process according to claim 1 wherein the oil is selected from the group comprising marine oils, animal oils, vegetable oils, and mixtures and fractions thereof.

* * * * *